United States Patent [19]

Frey et al.

[11] Patent Number: 4,899,677

[45] Date of Patent: Feb. 13, 1990

[54] SEWING MACHINE PRESSER FOOT WITH NEEDLE GUIDE FOR SLIDE FASTENER APPLICATION

[75] Inventors: Emmy Frey, Rorschach; Ernst Dreier, Steckborn, both of Switzerland

[73] Assignee: Fritz Gegauf Aktiengesellschaft Bernina-Nähmaschinenfabrik, Steckborn, Switzerland

[21] Appl. No.: 258,206

[22] Filed: Oct. 14, 1988

[30] Foreign Application Priority Data

Oct. 17, 1987 [CH] Switzerland ..... 4096/87

[51] Int. Cl.[4] ..... D05B 29/12; D05B 35/10; D05B 35/12

[52] U.S. Cl. ..... 112/151

[58] Field of Search ..... 112/153, 151, 235

[56] References Cited

U.S. PATENT DOCUMENTS

| | | | |
|---|---|---|---|
| 723,608 | 3/1903 | Joecken et al. | 112/151 |
| 1,071,365 | 8/1913 | Starr | 112/151 |
| 1,103,836 | 7/1914 | Raplee | 112/151 |
| 1,335,004 | 3/1920 | Lehigh | 33/165 |
| 1,604,238 | 10/1926 | Plumley | 33/165 |
| 1,918,643 | 7/1933 | Heck | 112/151 |
| 2,130,446 | 9/1938 | Rakov | 112/151 |
| 2,478,032 | 8/1949 | Wallsh | 112/235 X |
| 2,960,948 | 11/1960 | Weir | 112/151 |
| 4,058,070 | 11/1977 | Jones | 112/153 |

*Primary Examiner*—Andrew M. Falik

*Attorney, Agent, or Firm*—Peter K. Kontler

[57] ABSTRACT

The upper side of the sole plate in a sewing machine presser foot is formed with a transversely extending channel for the median portion of a guide which steers the needle during making of a row of stitches adjacent the edge of a marginal portion of a piece of fabric. To this end, the guide has two end portions which extend laterally beyond the respective sides of the sole plate and have downwardly bent tips one of which slides along the edge of a piece of fabric when the sewing machine is in use. The guide can be moved longitudinally to place its end portions at selected distances from the respective sides of the sole plate. A male detent member on the sole plate normally engages a selected graduation of a notched scale on the central portion of the guide to maintain the guide in a selected position. The tips of end portions of the guide are located at a level slightly above that of the underside of the sole plate.

16 Claims, 2 Drawing Sheets

SEWING MACHINE PRESSER FOOT WITH NEEDLE GUIDE FOR SLIDE FASTENER APPLICATION

BACKGROUND OF THE INVENTION

The invention relates to sewing machines in general, and more particularly to improvements in a presser foot for use in sewing machines, especially in sewing machines wherein the needle should or must be guided during the making of a row of stitches in a piece of fabric or the like.

It is already known to equip a sewing machine with a guide which advances along a selected path so as to ensure that the needle will make a row of stitches at a certain distance from the edge of a piece of fabric. However, heretofore known guides cannot be employed when a sewing machine is to attach two pieces of fabric to the tapes of a slide fastener in such a way that the two pieces of fabric meet or are immediately adjacent each other in front of the slide fastener in order to at least partially or fully conceal the slide fastener while permitting access to the slide piece.

U.S. Pat. No. 3,002,477 discloses a presser foot for use in sewing machines which serve to secure the tapes of slide fasteners to pieces of fabric or the like. The patented sewing machine operates with two needles one of which forms stitches in close proximity to one row of slide fastener teeth and the other of which forms stitches at a greater distance from the one row of teeth. Such stitches secure the piece of fabric to the respective tape of the slide fastener. The presser foot carries a pivotably mounted plate which can be moved to an operative position at one side of the sole plate to define with the sole plate a passage for one row of slide fastener teeth. The patented presser foot cannot be used for attachment of pieces of fabric to the tapes of a slide fastener in such a way that the marginal portions of the pieces of fabric overlie and at least partially conceal the slide fastener.

German Auslegeschrift No. 1 017 010 of Lechel discloses a presser foot which carries a horizontal bar at a level above the sole plate. One end portion of the bar supports a housing which contains a coil spring and is rigid with a guide serving to slide along the table of a sewing machine adjacent the edge of a piece of fabric. The spring ensures that the guide bears against the table even if the sole plate of the presser foot is caused to rise and descend during travel along the upper side of a piece of fabric. The guide and its housing can be turned about the end portion of the bar so as to move the guide to an inoperative position well above the level of the sole plate. The bar can be adjusted relative to the presser foot in response to loosening of a screw which secures the bar to the shank of the presser foot above the sole plate. The guide can be installed only at one side of the sole plate of the presser foot. If a guide is needed at the other side of the presser foot, the single guide must be transferred or a second guide must be installed at the other end of the bar. The structure which is disclosed by Lechel cannot be used to attach pieces of fabric to the tapes of a snap fastener in a manner such as to conceal the snap fastener behind the marginal portions of the pieces of fabric.

OBJECTS OF THE INVENTION

An object of the invention is to provide a novel and improved presser foot which is combined with a novel and improved guide in such a way that it can properly guide a needle at either side of the sole plate.

Another object of the invention is to provide a sewing machine which embodies the improved presser foot and the improved guide.

A further object of the invention is to provide a novel and improved guide for use with the presser foot and to provide a novel and improved presser foot for use with the guide.

An additional object of the invention is to provide a novel and improved compact, simple and inexpensive combination of a presser foot and needle guide which can be used with particular advantage in sewing machines for the attachment of slide fasteners to and for concealment of slide fasteners by pieces of fabric or the like.

Still another object of the invention is to provide a sewing machine wherein the guide can be mounted directly on the presser foot, and more particularly directly on the sole plate of the presser foot.

A further object of the invention is to provide a combination of presser foot and guide which is constructed and assembled in such a way that the operator of the sewing machine can ascertain at a glance whether or not the guide is properly positioned relative to the needle and vice versa.

Another object of the invention is to provide a guide which does not interfere with movements of the sole plate even though the guide need not be biased against the sewing machine and/or against the piece or pieces of fabric on the table of the sewing machine.

An additional object of the invention is to provide a guide which can properly control the movements of a needle at one or at the other side of the sole plate.

SUMMARY OF THE INVENTION

The invention is embodied in a presser foot, particularly in a presser foot which can be used in machines for sewing marginal portions of fabrics to slide fasteners so that the marginal portions overlie the slide fastener which is attached thereto. The improved presser foot comprises a sole plate, a fabric-engaging needle guide which extends transversely of the sole plate, and means for adjustably connecting the guide to the sole plate so that the guide is movable transversely of the sole plate between a plurality of different positions.

The sole plate can be provided with a channel (e.g., with a channel whose upper side is open) for the guide, and the connecting means can comprise means for yieldably biasing a median portion of the guide into the channel.

In accordance with a presently preferred embodiment of the invention, the connecting means comprises a male and a female detent member. One of the detent members is provided on the sole plate and the other detent member is provided on the guide and separably engages the one detent member. The female detent member can comprise a plurality of depressions which are provided in the upper side of the guide and form a row extending transversely of the sole plate (i.e., transversely of the direction of movement of the sole plate relative to a piece of fabric or vice versa when the sewing machine is in use), and the male detent member is then provided on the sole plate and includes a portion (e.g., a pointed projection) which normally extends into a selected depression. Such portion of the male detent member can be extracted from the selected depression so as to enable the guide to move relative to the sole plate and to place another depression into register with the portion of the male detent member. The depressions can constitute graduations of a scale which facilitates adjustment of the guide relative to the sole plate to a selected one of a plurality of different positions. It is clear that the positions of the scale an of the male detent member can be reversed without departing from the spirit of the invention. The portion of the male detent member can be said to constitute an index or marker which pinpoints a different graduation of the scale in each of the plurality of different positions of the guide relative to the sole plate. It will be seen that the means for pinpointing the selected position of the guide relative to the sole plate can form part of the connecting means. The male detent member is or can be resilient so that it stores energy when it is disengaged from the female detent member in order to enable the guide to move relative to the sole plate.

At least a portion of the guide can be made of a resilient material. For example, the guide can be made of spring steel.

The guide comprises two end portions which extend beyond the respective sides of the sole plate. Each end portion preferably comprises a downwardly extending tip which can engage the edge of a piece of fabric which is in the process of being provided with a row of stitches. Each end portion can further comprise a section which slopes downwardly from the respective tip toward the corresponding side of the sole plate. The central or median portion of the guide is or can be flat and overlies the sole plate. Such central portion can be provided with the aforediscussed depressions or graduations. The end portions of the guide extend to a level slightly above the underside of the sole plate. One of the tips moves toward and the other tip moves away from the sole plate during each adjustment of the guide with reference to the sole plate.

The novel features which are considered as characteristic of the invention are set forth in particular in the appended claims. The improved presser foot itself, however, both as to its construction and the mode of adjusting the guide with reference to the sole plate, together with additional features and advantages thereof, will be best understood upon perusal of the following detailed description of certain specific embodiments with reference to the accompanying drawing.

DESCRIPTION OF PREFERRED EMBODIMENTS

Figure 1:
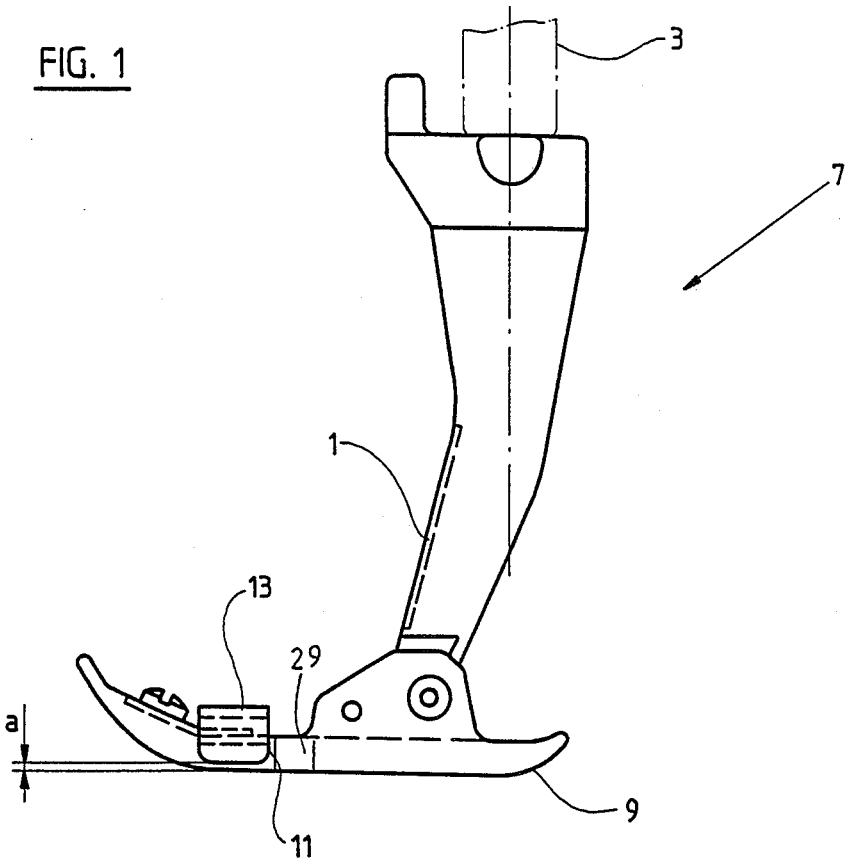
FIG. 1 is an enlarged side elevational view of a presser foot which is provided with the improved guide.
Figure 2:
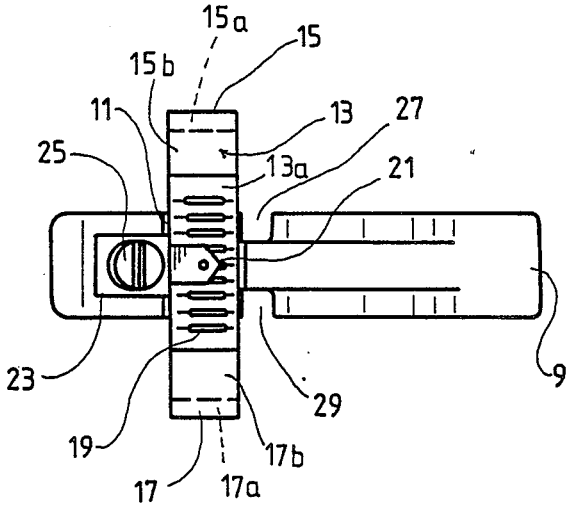
FIG. 2 is a plan view of the sole plate and of the guide.

FIGS. 1 and 2 show a presser foot 7 which comprises a shank 1, a presser bar 3 which carries the upper end portion of the shank, a sole plate 9 which is pivotally connected to the lower end portion of the shank 1, an elongated metallic guide 13 which extends transversely of the sole plate 9 (i.e., at right angles or substantially at right angles to the direction of travel of the sole plate relative to a piece of fabric or the like (or vice versa) when the sewing machine employing the presser foot is in actual use), and means for adjustably connecting the guide 13 to the sole plate 9. The pivot member between the shank 1 and the sole plate 9 of the presser foot 7 extends at right angles to the longitudinal direction of the sole plate.

The upper side of the sole plate 9 is provided with a transversely extending channel 11 for the median portion of the guide 13, and the guide is adjustable longitudinally of the channel 11 so that one of its end portions 15, 17 moves nearer to the respective side of the sole plate 9 while the other end portion moves away from the sole plate. The illustrated guide 13 has a rectangular outline and its end portions 15, 17 have downwardly bent vertical or nearly vertical tips 15*a*, 17*a* (FIGS. 3, 4) and sections 15*b*, 17*b* each of which extends downwardly (e.g., at an angle of 35 degrees) from the upper end of the respective tip toward the corresponding side of the sole plate 9. The median or central portion 13*a* of the guide 13 is flat or substantially flat, and its upper side is formed with a row of parallel depressions 19 constituting a graduated scale as well as a female detent member for retention of the guide 13 in any one of a plurality of different positions relative to the sole plate 9. A selected depression or graduation 19 receives the pointed end portion 21 of a male detent member 23 which is affixed to the front part of the sole plate 9 by a screw 25 or another suitable fastener. The male detent member 23 is resilient so that its end portion 21 can yield in response to exertion of a requisite push or pull against the guide 13 in a direction to move the guide longitudinally of the channel 11, i.e., transversely of the sole plate 9, in order to move the end portion 15 nearer to or further away from the corresponding side of the sole . plate while simultaneously moving the end portion 17 further away from or toward the other side of the sole plate. The end portion 21 of the male detent member 23 can be said to constitute an index or pointer which cooperates with the scale including the depressions or graduations 19 to enable the user of the machine to read the position of the guide 13 with reference to the sole plate. The median portion 13*a* of the guide 13 is or can be provided with numbers or with other information which facilitates a determination of the position of the guide 13 relative to the sole plate 9, namely the distance of the end portions 15, 17 from the respective sides of the sole plate.

The sides of the sole plate 9 are provided with recesses 27, 29 one of which enables the needle 31 (FIGS. 3 and 4) to penetrate into the fabric beneath the sole plate.

The lowermost points of the tips 15*a*, 17*a* of the end portions 15, 17 are disposed at a small distance a (FIG. 1) above the level of the underside of the sole plate 9. This is desirable and advantageous because the tip 15*a* or 17*a* is not caused to bear against a slide fastener 41 (FIGS. 3 and 4) with an excessive force while the underside of the sole plate 9 moves relative to the piece of fabric which is in the process of being affixed to a tape forming part of the slide fastener or to another penetrable textile or other material.

The length of the median or central portion 13*a* of the guide 13 preferably exceeds (at least slightly) the width of the sole plate 9. Instead of employing a guide which includes the sloping sections 15*b*, 17*b*, the presser foot of the present invention can employ a thicker sole plate. The guide 13 can be made of spring steel, the same as the male detent member 23. This detent member, together with the fastener 25 and depressions or graduations 19 on the median portion 13*a* of the guide 13, constitutes the means for adjustably connecting the guide to the sole plate. Other types of connecting means can be used with equal or similar advantage. For example, the median portion of the guide can be received in a transversely extending tunnel-shaped channel of the sole plate 9 with a reasonably high degree of friction so that it is not likely to leave a selected position unless the operator applies a force which is greater than those acting upon the guide when the presser foot employing such combination of guide and sole plate is in use. The fastener 25 can be omitted if the resilient male detent member 23 is permanently bonded (e.g., spot welded) to the sole plate 9.

The central depression or graduation 19 can be identified by the numeral "0", the two graduations flanking the central graduation can be identified by numerals "1", the next graduations at the two sides of the "0" graduation can be identified by numerals "2", and so forth. Other types of indicia can be used if desired.

Figure 3:
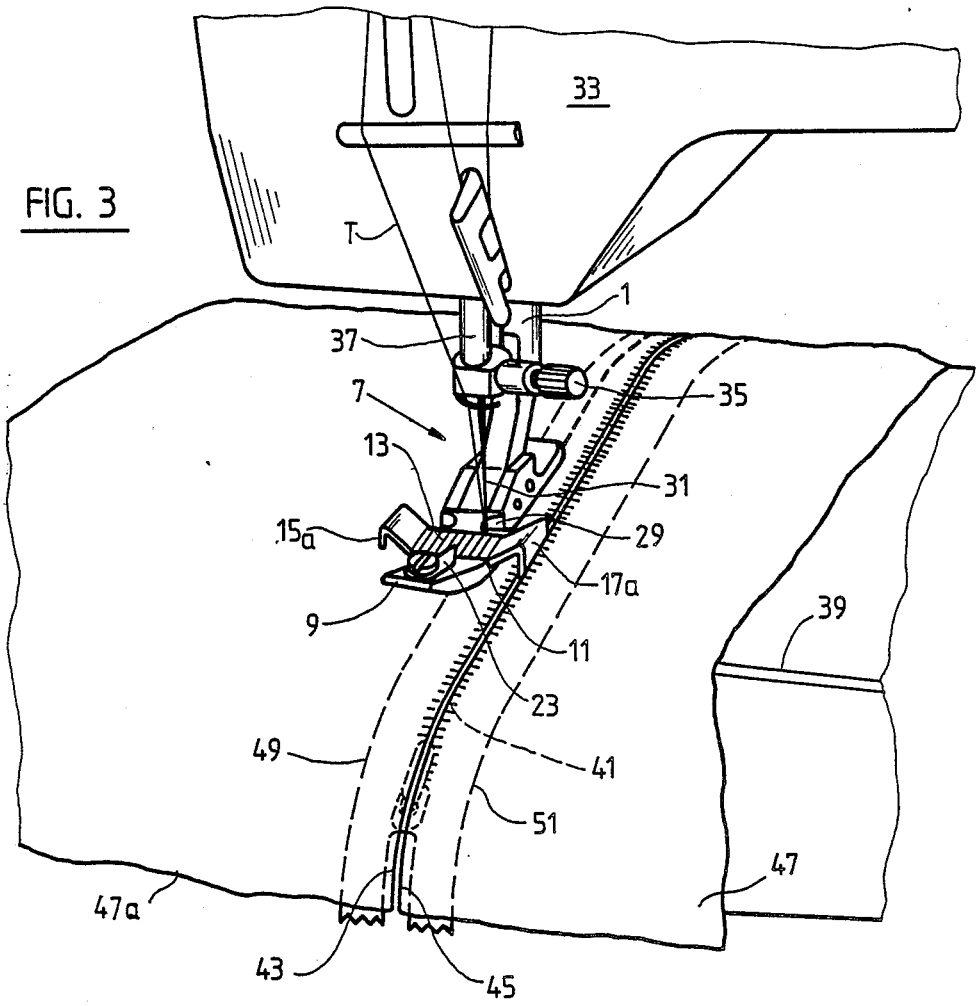
FIG. 3 is a fragmentary perspective view of a sewing machine which embodies the presser foot of FIGS. 1 and 2, the guide being shown in a position it assumes while guiding the needle along the marginal portion of one of two pieces of fabric which are sewn to the tapes of a slide fastener so as to overlie and conceal the slide fastener.
Figure 4:
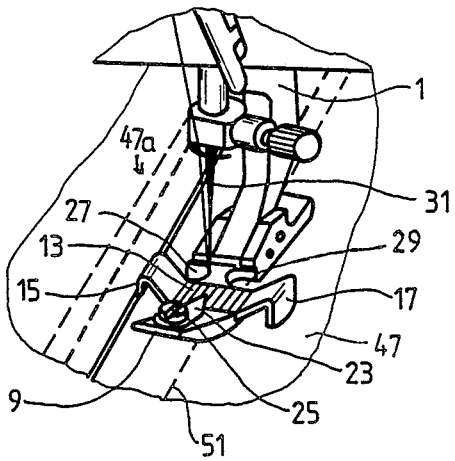
FIG. 4 is a perspective view of a portion of the structure of FIG. 3, showing the guide in a position while guiding the needle along the marginal portion of the other piece of fabric.

FIG. 3 shows a portion of a sewing machine 33 having a table or support 39 for the parts to be sewn together and employing a presser foot 7 of the type shown in FIGS. 1 and 2. The needle 31 is separably secured to the lower end of a vertically movable shaft 37 by a screw 35 having a knurled head or in any other suitable way. The sole plate 9 of the presser foot 7 is shown above a piece 47*a* of fabric having a marginal portion which overlies substantially one-half of a slide fastener 41 on the table 39 in such a way that the edge 43 of such marginal portion is immediately or closely adjacent the edge 45 of the marginal portion of a second piece 47 of fabric. The needle 31 is to cause the thread T to form a row of stitches 49 which are disposed at a selected distance from the edge 43. To this end, the edge 43 is contacted by the tip 17*a* of the end portion 17 of the guide 13 while the piece 47*a* of fabric is caused to move forwardly relative to the presser foot 7. The other end portion 15 of the guide 13 is located at a level above the piece 47*a* of fabric while the tip 17*a* of the end portion 17 extends into the narrow gap between the edges 43, 45. It is assumed that the piece 47 of fabric is already sewn to the right-hand tape of the slide fastener 41 by a row of stitches 51; if not, the piece 47 of fabric is temporarily affixed to the respective tape by pins or by baste stitches, not shown. Such baste stitches and/or pins can be used to provisionally secure the left-hand tape of the slide fastener 41 to the piece 47*a* of fabric preparatory to and during the making of stitches 49.

The difference or distance a between the levels of the lowermost points of the tips 15*a*, 17*a* and the underside of the sole plate 9 is selected with a view to ensure that frictional engagement between the tip 17*a* and the upper sides of interlocked teeth of the slide fastener 41 (while the underside of the sole plate 9 contacts the upper side of the piece 47*a* of fabric) is nil or negligible. The distance a can match the height of a slide fastener tooth which rests on the table 39 of the sewing machine 33.

Prior to proceeding with the sewing operation, the person in charge selects the position of the end portion 17, i.e., the distance of the tip 17*a* from the respective side of the sole plate 9, in order to determine the distance of the row of stitches 49 from the edge 43. Such adjustment is carried out by pushing or pulling the guide 13 relative to the sole plate 9 so that the end portion 21 of the male detent member 23 rides over one or more ribs between neighboring depressions or graduations 19 at the upper side of median portion 13*a* of the guide 13. The detent member 23 then stores energy and propels its end portion 21 into that depression or graduation 19 which registers with the end portion 21. Such adjustment (if necessary) of the position of the guide 13 relative to the sole plate 9 can take place prior to placing the slide fastener 41 and pieces 47*a*, 47 of fabric onto the table 39. The marginal portions of the pieces of fabric overlie the slide fastener 41 save for the narrow gap between the edges 43, 45 which is normally desirable to permit entry of the tip 17*a*.

In order to form the row of stitches 51, the operator transfers the shaft 37 and the needle 31 to the other side of the sole plate 9 so that the needle then penetrates through the lateral recess 29. Moreover, the position of the guide 13 relative to the sole plate 9 is adjusted (if necessary) so as to ensure that the row of stitches 51 will be formed at a desired distance from the edge 45. No adjustment of the guide 13 relative to the sole plate 9 is necessary if the distance between the rows of stitches 49, 51 matches the distance between the tips 15*a*, 17*a*.

Minor shifting of the piece 47 and/or 47*a* of fabric relative to the slide fastener 41 and/or vice versa during making of the stitches 49 and/or 51 does not detract from the appearance of the finished product, as long as the width of the gap between the edges 43, 45 is substantially constant and as long as the distance from the rows of stitches 49, 51 to the respective edges 43, 45 is substantially constant.

The improved combination of sole plate 9 and guide 13 exhibits a number of important advantages. Thus, a single guide suffices to make stitches at the left-hand side or at the right-hand side of the sole plate. Furthermore, the adjustment of guide 13 relative to the sole plate 9 is simple and can be carried out without resorting to any tools, or by resorting to a rudimentary tool, with little loss in time. The guide 13 can be moved to any desired number of different positions (e.g., by omitting the depressions or graduations 19) and by causing the male detent member 23 to simply bear against the smooth upper side of the median portion 13*a* of the guide 13. The sewing machine employing the improved presser foot 7 can be used to connect slide fasteners with pieces of fabric in such a way that the edges of the pieces of fabric abut or nearly abut or that such edges define a gap of desired width. Moreover, the means for connecting the guide 13 to the sole plate 9 in any one of a number of different positions can also serve as a means for pinpointing the selected position of the guide with reference to the sole plate. Since the guide 13 is preferably resilient, its inactive end portion can readily ride over the adjacent piece of fabric or the like even if the upper side of such piece of fabric is uneven so that the sole plate must ride up and down while it moves relative to the fabric or vice versa. Moreover, resiliency of the guide 13 ensures that the selected tip 15*a* or 17*a* remains in contact with the adjacent edge of the piece of fabric which is being sewn to the tape of a slide fastener or to any other part. Still further, resiliency of the guide 13 ensures that the inactive end portion (such as the end portion 15 in FIG. 3) cannot interfere with travel of the tip of the other end portion along the edge of the piece of fabric which is in the process of being sewn to the tape of a slide fastener.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A presser foot, particularly for use in machines for sewing marginal portions of fabrics to slide fasteners so that the marginal portions overlie the slide fastener which is attached thereto, comprising a sole plate having first and second sides and a channel; a fabric-engaging guide extending into said channel transversely of said sole plate and having first and second end portions extending beyond the respective sides of said sole plate, each of said end portions including a downwardly extending tip, and said tips being permanently fixed against translation towards and away from one another; and means for adjustably connecting said guide to said sole plate so that the guide is movable transversely of said sole plate between a plurality of different positions.

2. The presser foot of claim 1, wherein one of the parts including said sole plate and said guide has a graduated scale and the other of said parts has an index which pinpoints a different graduation of said scale in each of said plurality of different positions of said guide relative to said sole plate.

3. The presser foot of claim 1, comprising means for pinpointing the selected position of said guide relative to said sole plate.

4. The presser foot of claim 3, wherein said pinpointing means forms part of said connecting means.

5. A presser foot, particularly for use in machines for sewing marginal portions of fabrics to slide fasteners so that the marginal portions overlie the slide fastener which is attached thereto, comprising a sole plate having first and second sides; a fabric-engaging guide extending transversely of the sole plate and having first and second end portions extending beyond the respective sides of said sole plate, each of said end portions including a downwardly extending tip and a section which slopes downwardly from the respective tip toward the corresponding side of said sole plate; and means for adjustably connecting said guide to said sole plate so that the guide is movable transversely of said sole plate between a plurality of different positions.

6. The presser foot of claim 5, wherein said guide further comprises a substantially plane central portion overlying said sole plate and disposed between said end portions.

7. A presser foot, particularly for use in machines for sewing marginal portions of fabrics to slide fasteners so that the marginal portions overlie the slide fastener which is attached thereto, comprising a sole plate having first and second sides; a fabric-engaging guide extending transversely of the sole plate and having first and second end portions extending beyond the respective sides of said sole plate, each of said end portions including a downwardly extending tip and said tips being permanently fixed against translation towards and away from one another; and means for adjustably connecting said guide to said sole plate so that the guide is movable transversely of said sole plate between a plurality of different positions, said connecting means comprising a male and a female detent member, one of said members being provided on said sole plate and the other of said members being provided on said guide and separably engaging said one member.

8. A presser foot, particularly for use in machines for sewing marginal portions of fabrics to slide fasteners so that the marginal portions overlie the slide fastener which is attached thereto, comprising a sole plate having first and second sides; a fabric-engaging guide extending transversely of the sole plate and having first and second end portions extending beyond the respective sides of said sole plate, each of said end portions including a downwardly extending tip and said tips being permanently fixed against translation towards and away from one another, said guide having a transverse central plane and said downwardly extending tips being substantially symmetrically arranged about said plane; and means for adjustably connecting said guide to said sole plate so that the guide is movable transversely of said sole plate between a plurality of different positions.

9. A presser foot, particularly for use in machines for sewing marginal portions of fabrics to slide fasteners so that the marginal portions overlie the slide fastener which is attached thereto, comprising a sole plate having first and second sides and an underside; a fabric-engaging guide extending transversely of the sole plate and having first and second end portions extending beyond the respective sides of said sole plate, said end portions being disposed at a level slightly above said underside and each of said end portions including a downwardly extending tip, said tips being permanently fixed against translation towards and away from one another; and means for adjustably connecting said guide to said sole plate so that the guide is movable transversely of said sole plate between a plurality of different positions.

10. A presser foot, particularly for use in machines for sewing marginal portions of fabrics to slide fasteners so that the marginal portions overlie the slide fastener which is attached thereto, comprising a sole plate having first and second sides; a fabric-engaging guide extending transversely of the sole plate and having first and second end portions extending beyond the respective sides of said sole plate, each of said end portions including a downwardly extending tip and said tips being permanently fixed against translation towards and away from one another, said guide having an upper side with a series of depressions forming a row extending transversely of said sole plate; and means for adjustably connecting said guide to said sole plate so that the guide is movable transversely of said sole plate between a plurality of different positions, said connecting means including a male detent member provided on said sole plate and having a portion normally extending into a selected one of said depressions, said portion of said detent member being movable out of the selected depression so as to enable said guide to move relative to said sole plate and to place another depression into register with said portion of said detent member.

11. The presser foot of claim 10, wherein said depressions constitute the graduations of a scale which facilitates adjustment of said guide to a selected one of said plurality of different positions.

12. A presser foot, particularly for use in machines for sewing marginal portions of fabrics to slide fasteners so that the marginal portions overlie the slide fastener which is attached thereto, comprising a sole plate having first and second sides; a fabric-engaging guide extending transversely of the sole plate and having first and second end portions extending beyond the respective sides of said sole plate, each of said end portions including a downwardly extending tip and said tips being permanently fixed against translation towards and away from one another; and means for adjustably connecting said guide to said sole plate so that the guide is movable transversely of said sole plate between a plurality of different positions, one of the parts including said sole plate and said guide having a graduated scale and the other of said parts having an index which pinpoints a different graduation of said scale in each of said plurality of different positions of said guide relative to said sole plate, one of said end portions moving toward and the other moving away from said sole plate during each adjustment of said guide relative to said sole plate.

13. A presser foot, particularly for use in machines for sewing marginal portions of fabrics to slide fasteners so that the marginal portions overlie the slide fastener which is attached thereto, comprising a sole plate having first and second sides; a fabric-engaging guide extending transversely of the sole plate and having first and second end portions extending beyond the respective sides of said sole plate, each of said end portions including a downwardly extending tip and said tips being permanently fixed against translation towards and away from one another; and means for adjustably connecting said guide to said sole plate so that the guide is movable transversely of said sole plate between a plurality of different positions, said connecting means including a resilient member which stores energy during adjustment of said guide relative to said sole plate.

14. A presser foot, particularly for use in machines for sewing marginal portions of fabrics to slide fasteners so that the marginal portions overlie the slide fastener which is attached thereto, comprising a sole plate having a channel and first and second sides; a fabric-engaging guide extending into said channel transversely of said sole plate and having first and second end portions extending beyond the respective sides of said sole plate, each of said end portions including a downwardly extending tip and said tips being permanently fixed against translation towards and away from one another; and means for adjustably connecting said guide to said sole plate so that the guide is movable transversely of said sole plate between a plurality of different positions, said connecting means including means for biasing said guide into said channel.

15. A presser foot, particularly for use in machines for sewing marginal portions of fabrics to slide fasteners so that the marginal portions overlie the slide fastener which is attached thereto, comprising a sole plate having first and second sides; a fabric-engaging guide extending transversely of the sole plate and having first and second end portions extending beyond the respective sides of said sole plate, each of said end portions including a downwardly extending tip and said tips being permanently fixed against translation towards and away from one another, at least a portion of said guide being resilient; and means for adjustably connecting said guide to said sole plate so that the guide is movable transversely of said sole plate between a plurality of different positions.

16. The presser foot of claim 15, wherein said guide consists of spring steel.

* * * * *